US007408562B2

(12) United States Patent
Kotsuji

(10) Patent No.: US 7,408,562 B2
(45) Date of Patent: Aug. 5, 2008

(54) ION GENERATING APPARATUS

(75) Inventor: Kazuo Kotsuji, Tokyo (JP)

(73) Assignee: Koganei Corporation, Tokyo (JP)

( * ) Notice: Subject to any disclaimer, the term of this patent is extended or adjusted under 35 U.S.C. 154(b) by 185 days.

(21) Appl. No.: 10/570,085

(22) PCT Filed: Aug. 24, 2004

(86) PCT No.: PCT/JP2004/012449

§ 371 (c)(1),
(2), (4) Date: Mar. 1, 2006

(87) PCT Pub. No.: WO2005/025022

PCT Pub. Date: Mar. 17, 2005

(65) Prior Publication Data

US 2007/0006478 A1 Jan. 11, 2007

(30) Foreign Application Priority Data

Sep. 2, 2003 (JP) ..... 2003-309686

(51) Int. Cl.
*H01T 23/00* (2006.01)
*H01T 19/04* (2006.01)

(52) U.S. Cl. ..... 347/123; 361/231

(58) Field of Classification Search ..... 347/123
See application file for complete search history.

(56) References Cited

U.S. PATENT DOCUMENTS 6,508,982 B1 * 1/2003 Shoji ..... 422/22
2006/0232908 A1 * 10/2006 Izumi et al. ..... 361/220

FOREIGN PATENT DOCUMENTS

JP 2003-135138 5/2003

OTHER PUBLICATIONS

Machine-generated translation of JP 2003-135138 cited in the IDS filed on Mar. 1, 2006.*

* cited by examiner

*Primary Examiner*—Huan H Tran
(74) *Attorney, Agent, or Firm*—McCormick, Paulding & Huber LLP

(57) ABSTRACT

A head 2 has a through hole 7 into which compressed air is supplied and flows, and a discharge electrode 11 is disposed inside the through hole 7. When a voltage required for discharging is applied to the head 2 made of a conductor and the discharge electrode 11, a corona C is generated at a tip end 11*a* of the discharge electrode 11, whereby flowing air is ionized. By a cylindrical housing tube portion 17 made of an insulator and receiving most of the discharge electrode 11 and a tapered guide portion (transfer fluid guiding member) 18 formed at a downstream-side end thereof, an air flow is biased and guided on a side of an outer circumference thereof so as not to rush directly against the corona generating region. Thus, even when air supply pressure is increased, an ion balance can be stabilized without almost changing pressure or a flow rate in the corona generating region.

6 Claims, 5 Drawing Sheets

ION GENERATING APPARATUS

TECHNICAL FIELD

The present invention relates to an ion generating apparatus for generating ionized air used for removing static electricity from various members such as electronic parts.

BACKGROUND ART

In manufacturing or assembling electronic parts such as semiconductor chips, if static electricity is generated in the electronic parts or jigs for manufacturing and assembling the same, it is not possible to smoothly manufacture or assemble the electronic parts. Thus, an ion generating apparatus also called an ionizer or ion generator is used to blow air which has been subjected to ionization, i.e., ionized air to members requiring removal of electrostatic charge. The members which require electrostatic charge removal, namely, removal of static electricity include a pipe for guiding air or liquid and an operating portion in a machine such as a robot or parts feeder, in addition to the aforementioned electronic parts. The ionized air is supplied to surfaces of such members, whereby electrostatic charge thereon is neutralized.

The ion generating apparatus used in such applications has a blow type, in which the ionized air is guided to a predetermined place requiring removal of electrostatic charge through a tube or pipe, and a fan type in which the ionized air is blown from a blowing port using a fan. The blow type ion generating apparatus has a head made of a conductor and having a through hole for guiding air therein, and a discharge electrode made of a conductor and disposed inside the through hole, wherein an insulating member is attached to an inner face of the through hole. A fitting is attached to the head, and the ionized air is supplied to a predetermined charged place through a hose or pipe or the like connected to the head via the fitting. On the other hand, the fun type ion generating apparatus has a duct for forming an air guide passage, and a discharge electrode disposed inside the duct, wherein the ionized air is guided through the duct to the predetermined charged place.

Regardless of the above types, a basic structure for generating ions is such that several kV or more AC voltage (or pulsed DC voltage) is applied to the discharge electrode to produce a corona discharge, whereby air flowing in an air flow passage is ionized by an electric field of the corona discharge.

However, in order to generate a large amount of ionized air, an increase of a flow rate of air in the air flow passage becomes necessary, whereby the pressure or flow rate in the air flow passage is increased, which results in any fear of making the corona discharge around the discharge electrode unstable. As described above, when the corona discharge becomes unstable, a ratio of positive ions to negative ions, that is, an ion balance is easily biased also in the ionized air generated and thus there is the problem that electrostatic charge removal performance or the like is reduced.

An object of the present invention is to provide an ion generating apparatus capable of stabilizing an ion balance even in generating a large amount of ionized air.

DISCLOSURE OF THE INVENTION

An ion generating apparatus according to the present invention comprises: a conductor blow tube having a through hole, which is formed therein and communicates with a fluid inlet port formed in an apparatus body and in which transfer fluid flows; a discharge electrode whose tip end is positioned in the through hole; and a transfer fluid guiding member for guiding a flow direction so that the transfer fluid does not rush directly against a corona generating region formed around the tip end.

The ion generating apparatus according to the present invention is such that a downstream-side end of the transfer fluid guiding member with respect to a flow direction of the transfer fluid is positioned on a more upstream side in the flow direction than the corona generating region.

An ion generating apparatus according to the present invention comprises: an apparatus body incorporating an air blower therein; a duct attached to the apparatus body and guiding transfer fluid discharged from the air blower to the outside; a discharge electrode whose tip end is positioned and attached in the duct; a pair electrode attached in the duct; and a transfer fluid guiding member for inducting the flow direction so that the transfer fluid does not rush directly against the corona generating region formed around the tip end.

According to the present invention, the transfer fluid guiding member biases and guides the air flow on an outer circumference side thereof so as not to rush directly against the corona generating region. For this reason, even when a large amount of ionized air is generated, an ion balance can be almost stabilized without changing pressure or a flow rate in the corona generating region.

Further, according to the present invention, since the downstream-side end of the transfer fluid guiding member is positioned on a more upstream side than a tip end of the discharge electrode disposed at the same position as that of the corona generating region, ions are carried better by the air flowing immediately outside the corona and the ion balance is further stabilized.

Furthermore, according to the present invention, the transfer fluid guiding member divides the air flow and biases and guides the divided air flows in a side direction of the entire discharge electrode and the corona generating region so as not to rush not directly against the corona generating region. Therefore, even when the large amount of ionized air is generated, the ion balance can be stabilized without almost changing the pressure or flow rate in the corona generating region.

BRIEF DESCRIPTION OF THE DRAWINGS

FIG. 5 is a schematic sectional view showing an ion generating apparatus according to another embodiment of the present invention, wherein

BEST MODES FOR CARRYING OUT THE INVENTION

Figure 1:
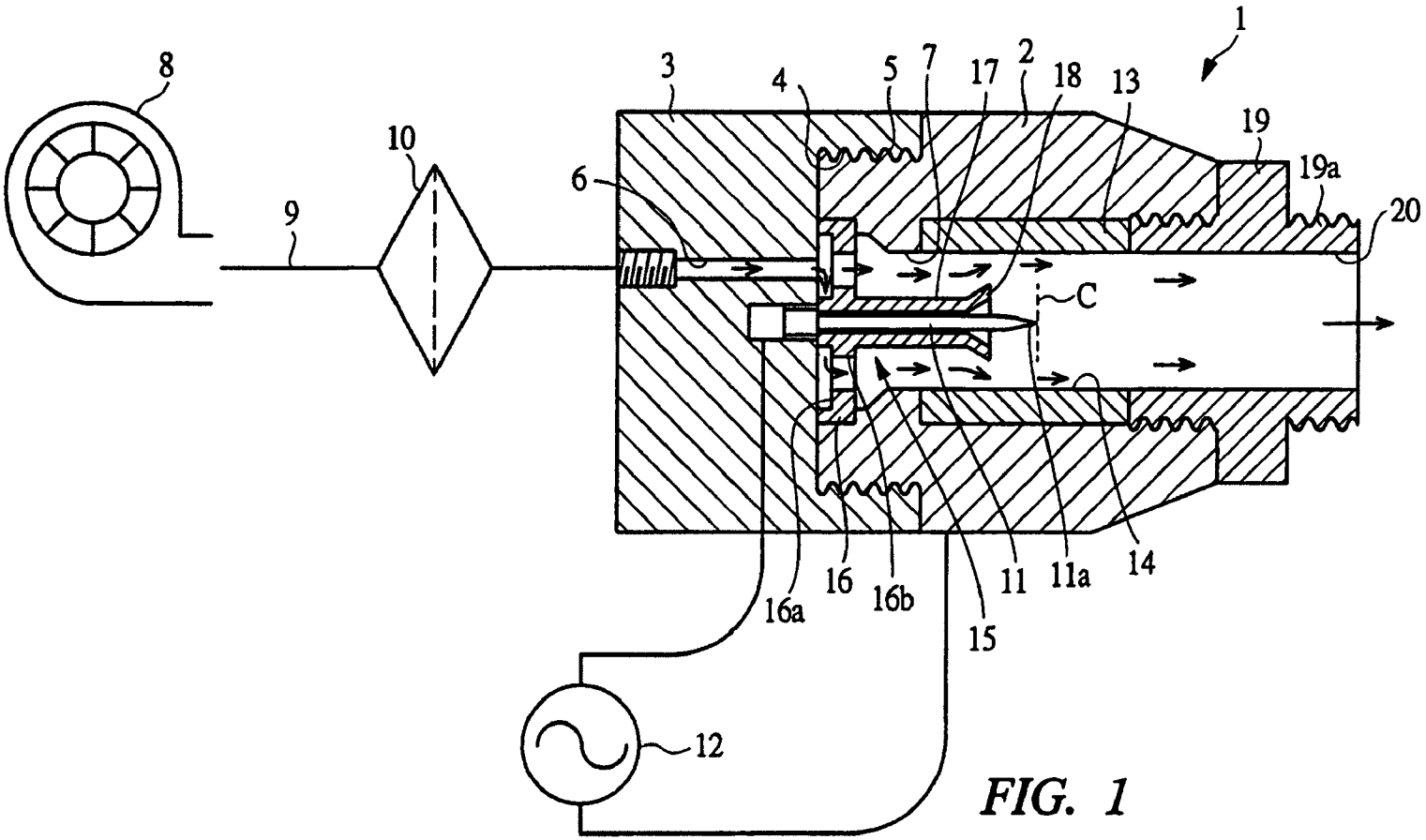
FIG. 1 is a schematic sectional view showing an ion generating apparatus according to one embodiment of the present invention.

Hereinafter, embodiments of the present invention will be detailed based on the drawings. FIG. 1 is a schematic sectional view showing an ion generating apparatus according to one embodiment of the present invention. The ion generating apparatus according to the present embodiment is an apparatus for generating ionized air by using atmospheric air as transfer fluid, and is of a blow type in which the ionized air generated can be locally injected to a predetermined place through a pipe type nozzle or the like.

As shown in FIG. 1, an ion generating apparatus 1 has an apparatus body 3 on which a head 2 made of a conductor such as a metal or conductive material is detachably mounted. The apparatus body 3 is made of an insulating material such as a resin or ceramic, and a male screw portion 5 to be screwed and connected into a screw hole 4 formed in the apparatus body 3 is formed at the head 2 serving as a conductor blow tube. The head 2 is hollow and has a through hole 7 which communicates with an air inlet port 6 (fluid inlet port) formed in the apparatus body 3.

An air supply source 8 such as a fan or compressor is connected to the air inlet port 6 through an air introduction passage 9, and the air introduction passage 9 is provided with a filter 10 for removing foreign materials such as dust in compressed air supplied from the air supply source 8.

A discharge electrode 11 is attached to the apparatus body 3, and most of the discharge electrode 11 including its tip end 11*a* is disposed inside the through hole 7 of the head 2. The head 2 made of a conductor and the discharge electrode 11 each constitute a paired discharging electrode, and a power supply unit 12 capable of supplying a voltage required for discharging is connected to the head 2 and the discharge electrode 11.

A cylindrical bush 13 serving as an insulating member is assembled in the head 2. An outer circumferential face of the bush 13 is fitted in an inner circumferential face of the through hole 7, and an inner circumferential face of the bush 13 serves as an air guide flow passage 14 communicating with the air supply source 8 through the air introduction passage 9. Therefore, the compressed air supplied from the air supply source 8 flows from one end of the bush 13 to the other end thereof.

An air introduction member 15 made of an insulating material such as a resin or ceramic is fitted in the inner circumferential face of the through hole 7 of the head 2 and is located on a more upstream side in an air flow direction than the bush 13. The air introduction member 15 comprises a disk-shaped uniform injection portion 16 located on the upstream side, a cylindrical housing tube portion 17 for receiving most of the discharge electrode 11 on an inside-diameter side, and a tapered guide portion 18 formed in a tapered shape at a downstream-side end of the housing tube portion 17, wherein the housing tube portion 17 and the tapered guide portion 18 constitute a transfer fluid guiding member.

An outer circumferential portion of the uniform injection portion 16 is fitted in the inner circumferential face of the through hole 7 of the head 2, and both end faces of uniform injection portion 16 are sandwiched and fixed between the apparatus body 3 and the head 2, whereby the entire air introduction member 15 is fixedly installed. The housing tube portion 17 is disposed at a center of the uniform injection portion 16, so that the discharge electrode 11 penetrates through an interior of the housing tube portion 17. An annular flow groove 16*a* is concentrically formed in an upstream-side end face of the uniform injection portion 16, and a plurality of flow holes 16*b* are formed at regular intervals on a downstream-side end face in a circumferential direction, wherein the air inlet port 6 of the apparatus body 3 communicates with the through hole 7 through the annular flow groove 16*a* and the flow holes 16*b*. The tapered guide portion 18 deposited at a downstream-side end of the housing tube portion 17 is formed in a tapered shape, whose diameter increases toward the downstream side, and the downstream-side end thereof is disposed on a more upstream side than the tip end 11*a* of the discharge electrode 11.

A nozzle fitting 19 is screwed and connected into the through hole 7 of the head 2 on the downstream side of the bush 13, and the nozzle fitting 19 has a protrusion screw portion 19*a* which protrudes from a tip end of the head 2, and a communication hole 20 which communicates with the air guide flow passage 14 of the bush 13. This nozzle fitting 19 is detachable from the head 2, and can be detachably attached to an unshown pipe type nozzle by its protrusion screw portion 19*a*.

The ion generating apparatus 1 having the above-mentioned structure is one for generating ionized air to be supplied to any charged places for removal of electricity.

An operation of the ion generating apparatus 1 according to the present embodiment will be described below. In FIG. 1, when several kV or more AC voltage is supplied to the head 2 and the discharge electrode 11 constituting the discharging electrodes from the power supply unit 12, a corona discharge occurs for generating a corona C between the discharging electrodes, so that the air flowing in the air guide flow passage 14 is ionized by the corona discharge. The ionized air is supplied to the predetermined charged place through the unshown pipe type nozzle or the like mounted on the nozzle fitting 19, whereby electrostatic charge of the charged place is removed.

Herein, the corona C is generated around the tip end 11*a* of the discharge electrode 11, and the housing tube portion 17 and the tapered guide portion 18 in the air introduction member 15 guide such a flow direction that the air flowing in the air guide flow passage 14 does not directly rush against a corona generating region formed around the tip end 11*a*. That is, the housing tube portion 17 protects the discharge electrode 11 so that the air flow does not directly rush against it, and the tapered guide portion 18 biases and guides the air flow on an outer circumferential side than the corona generating region. Thus, even when a flow amount of air is changed to increase or decrease generation of the ionized air, a change in the pressure or flow rate in the corona generating region can be almost prevented, whereby the ionization of air, that is, the generation of ions is always maintained stably. In particular, when an air density is increased due to an increase in pressure, a failure of not obtaining the stabilized corona discharge can be prevented. Such stabilization of the corona discharge leads to stabilization of a ratio of a generation amount of positive ions to that of negative ions, that is, an ion balance, thereby making it possible to approach to a state of generating the same amounts of positive ions and negative ions and being ideal for electrostatic charge removal performance.

Figure 2:
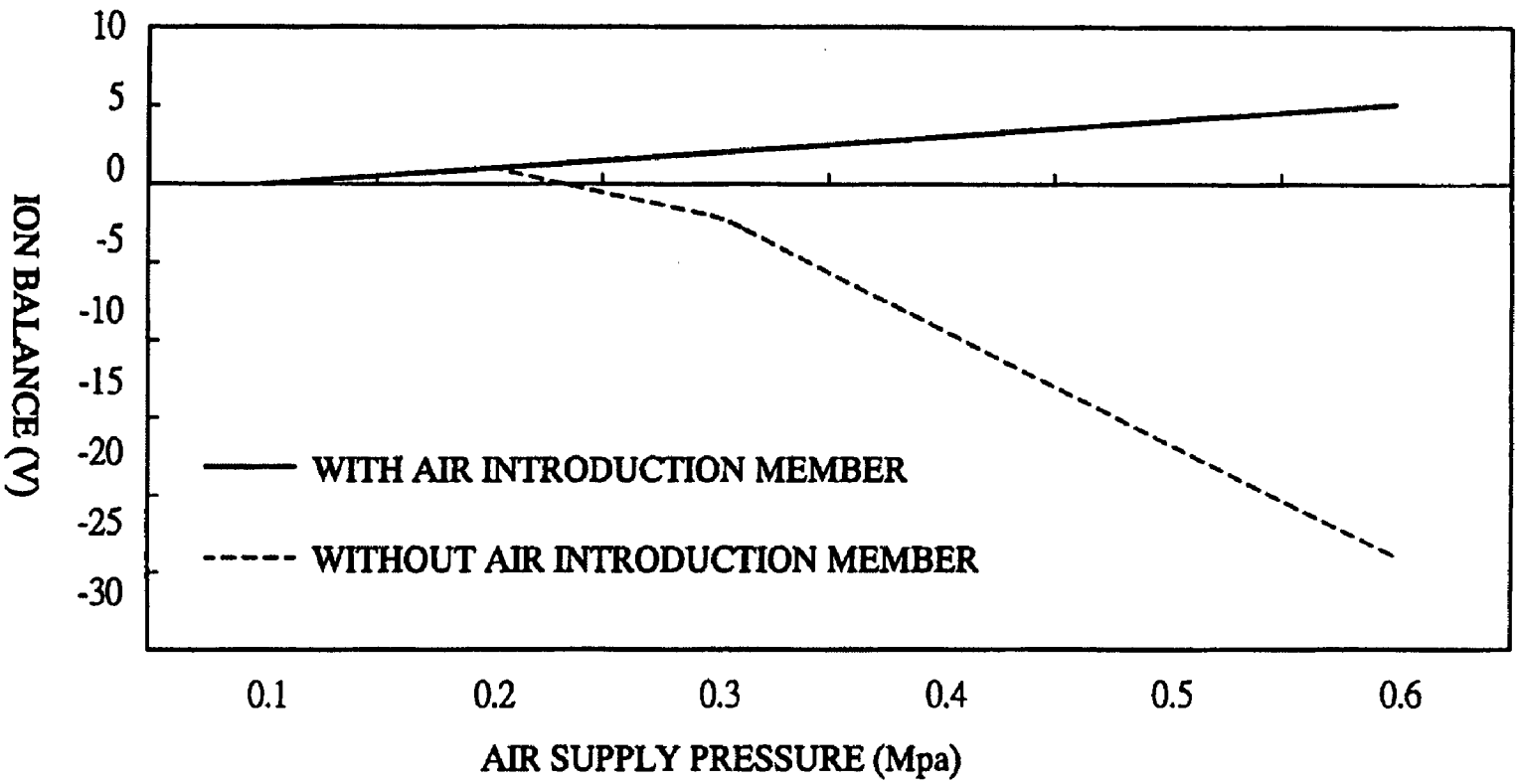
FIG. 2 is a view showing a comparison of a change in ion balance with a change in air supply pressure between the ion generating apparatus according to one embodiment and an ion generating apparatus without an air introduction member.

FIG. 2 is a diagram for comparing a change in an ion balance with a change in air supply pressure between the ion generating apparatus 1 according to the present embodiment and another ion generating apparatus without the air introduction member 15. The horizontal axis indicates an increase/decrease in supply pressure and the vertical axis indicates an ion balance in terms of electric potential of the entire ionized air. In this figure, in the case of the ion generating apparatus without the air introduction member 15, as the supply pressure increases as shown by the dashed lines in the figure, the ion balance significantly changes (goes on a negative side as shown). On the contrary, in the case of the ion generating apparatus 1 with the air introduction member 15 (transfer fluid guiding member) according to the present embodiment, even when the supply pressure is increased as shown by the solid line in the figure, a change in the ion balance is small and a state close to the state of generating the same amounts of positive ions and negative ions can be stably maintained.

Thus, according to the ion generating apparatus 1 of the present embodiment, even when a large amount of ionized air is generated, the ion balance can be stabilized, so that the ionized air with excellent electrostatic charge removal performance can be generated.

Further, when the transfer fluid guiding member constituted by the housing tube portion 17 and the tapered guide portion 18 receives the entire discharge electrode 11 so as to include the tip end 11*a*, ions generated by the corona discharge cannot be carried better. However, a downstream-side end of the tapered guide portion 18 that the ion generating apparatus 1 according to the present embodiment has is positioned on a more upstream side than the tip end 11*a* of the discharge electrode 11, so that air can flow in an outer circumference immediately outside the corona C. Therefore, it is possible to carry ions better to stabilize the ion balance.

Further, since air can uniformly flow toward the outer circumference of the discharge electrode 11 by the uniform injection portion 16, the ions generated by the corona discharge can be carried better to keep the ion balance more stabile.

Note that the transfer fluid guiding member is not limited to a structure in which the housing tube portion 17 and the tapered guide portion 18 are combined as shown in FIG. 1, and may have other structures if the flow direction is guides by the other structures so that the air flowing in the air guide flow passage 14 does not rush directly against the corona generating region.

Figure 3:
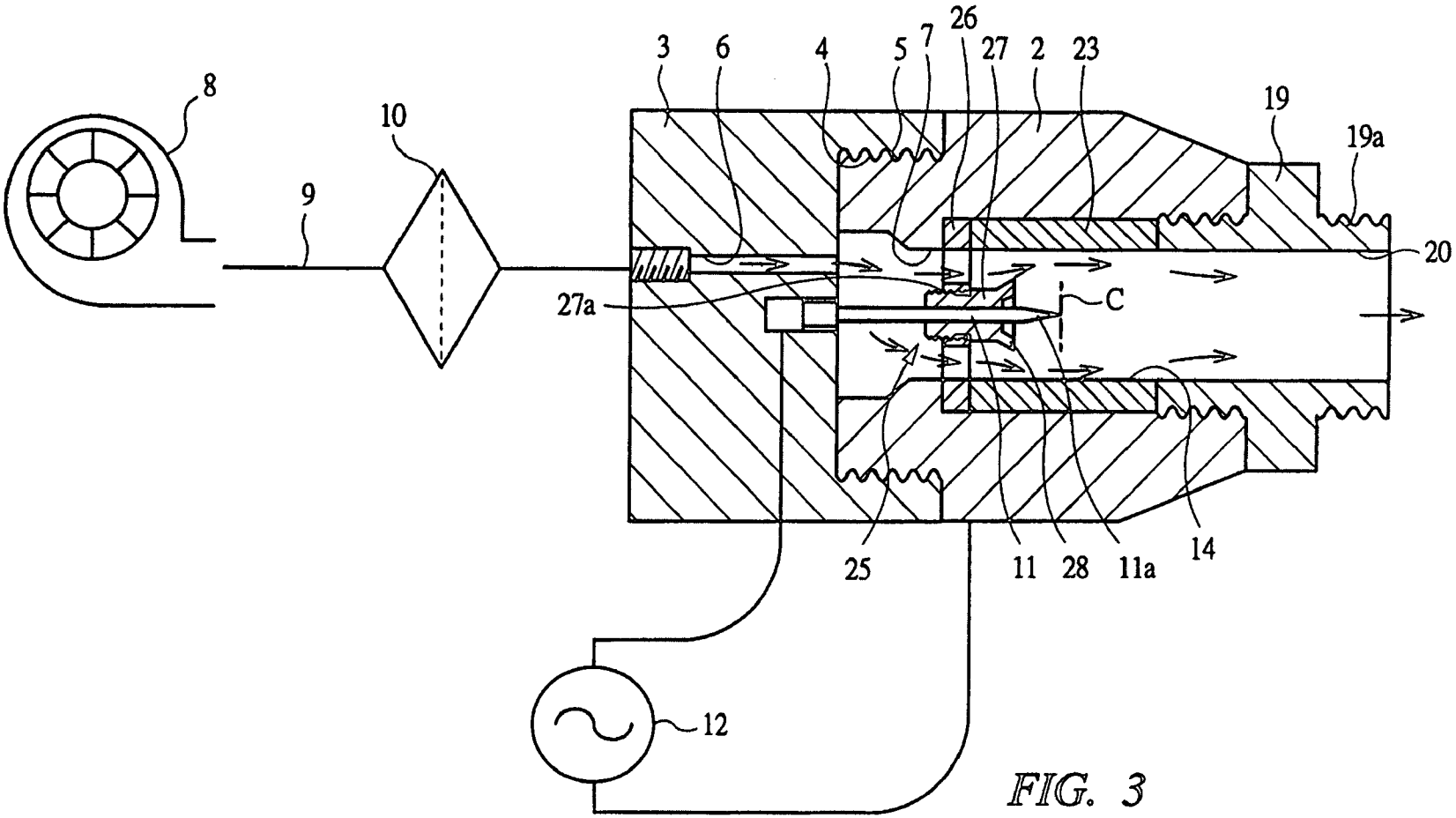
FIG. 3 is a schematic sectional view showing an ion generating apparatus according to a first modification of one embodiment of the present invention.
Figure 4:
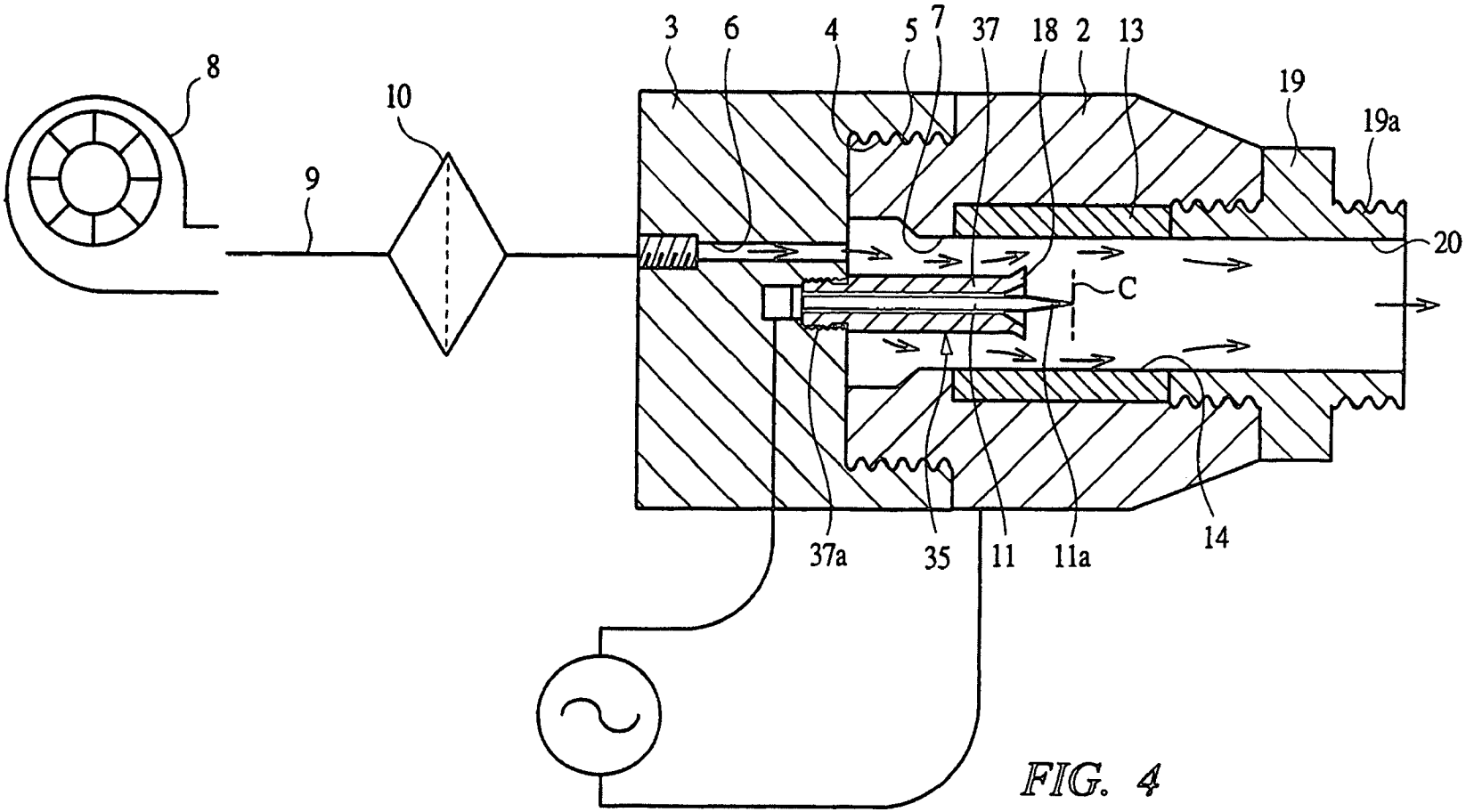
FIG. 4 is a schematic sectional view showing an ion generating apparatus according to a second modification of one embodiment of the present invention.

For example, like a first modification shown in FIG. 3, the modification may have a structure in which a uniform injection portion 26 is adjacently disposed on an upstream side of a bush 23 and a screw portion 27*a* formed at an upstream-side end of a housing tube portion 27 is screwed and connected into the uniform injection portion 26. Also in this case, a downstream-side end of a tapered guide portion 28 is positioned on a more upstream side than the tip end 11*a* of the discharge electrode 11, whereby the ions generated from the corona C can be carried better. Further, like a second modification shown in FIG. 4, the modification may have a structure in which a screw portion 37*a* formed at an upstream-side end of a housing tube portion 37 is directly screwed and connected into the apparatus body 3 without providing a uniform injection portion and is installed.

Figure 5A:
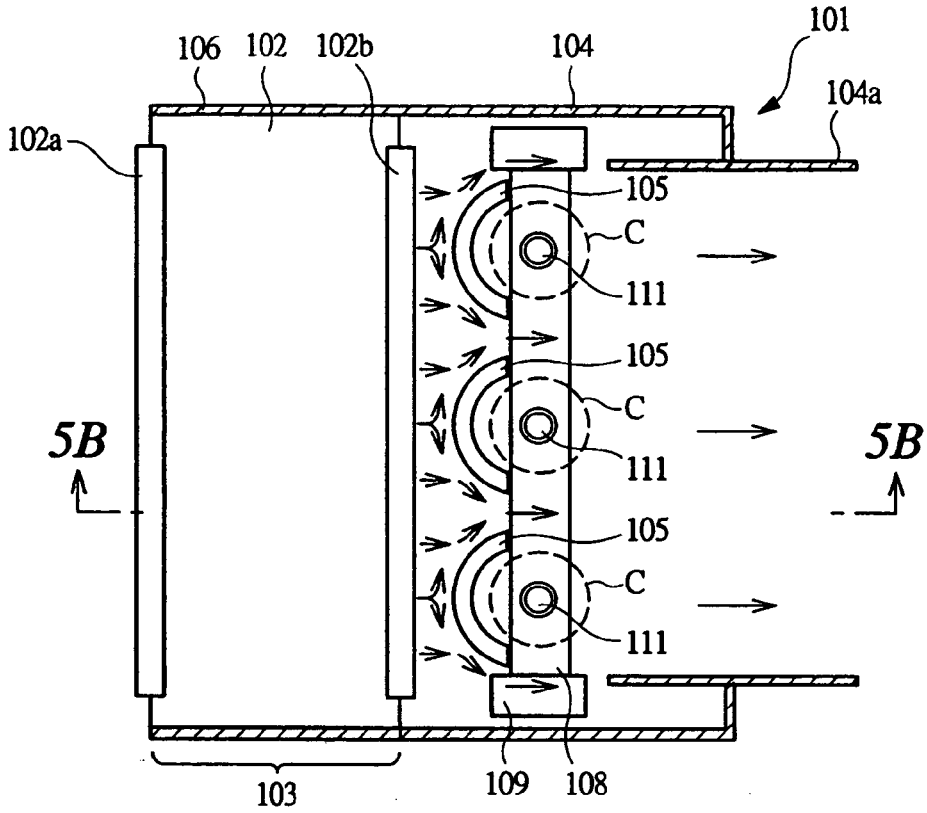
FIG. 5A is a plan sectional view taken along the line A-A of FIG. 5B
Figure 5B:
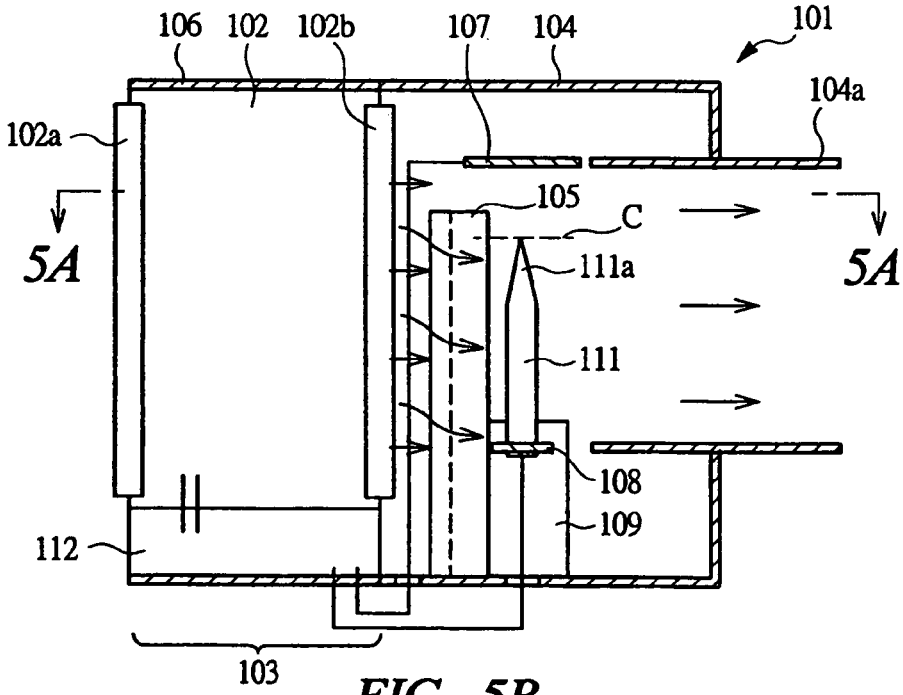
FIG. 5B is a side sectional view taken along the line B-B of FIG. 5A.

FIG. 5 is a schematic sectional view showing an ion generating apparatus according to another embodiment of the present invention, wherein FIG. 5A is a plan sectional view taken along the line A-A of FIG. 5B, and FIG. 5B is a side sectional view taken along the line B-B of FIG. 5A. The ion generating apparatus according to the present embodiment is one for generating ionized air by using atmospheric air fed from a fan, and is of a fan type in which the ionized air generated is blown from a duct. In this figure, members and shapes common to those in the ion generating apparatus 1 shown in FIG. 1 are denoted by the same reference numerals.

As shown in FIG. 5, an ion generating apparatus 101 according to the present embodiment has an apparatus body 103 provided with an air blower 102, a duct 104 attached to the apparatus body 103, three discharge electrodes 111 attached inside the duct 104, a pair electrode plate 107 which forms a pair electrode opposite to each discharge electrode 111, and a flow air guide member 105 made of a resin or the like and attached between the air blower 102 and each discharge electrode 111.

The apparatus body 103 comprises: the air blower 102 having, inside a housing 106, an air blower inlet port 102*a* for taking in air and an air blower outlet port 102*b* for blowing air into the duct 104; and a power supply unit 112. The power supply unit 112 has therein a power converter to acquire power for discharging, and supplies power to an unshown motor for driving the air blower 102.

The duct 104 attached to the housing 106 is formed in a substantially square cylindrical shape, so that the air discharged from the air blower outlet port 102*b* is guided through a duct outlet port 104*a* to the outside. The three discharge electrodes 111 are parallel to one another and are upright fixed to an electrode fixing plate 108 serving as a conductor, and this electrode fixing plate 108 is supported by an electrode fixing plate support 109. The discharge electrodes 111 are orthogonal to an air-flow direction from the air blower inlet port 102*b* towards the duct outlet port 104*a*. The pair electrode plate 107 serving as a conductor plate is fixed inside the duct 104 at a position perpendicularly opposite to and spaced from a tip end 111*a* of each discharge electrode 111. Each discharge electrode 111 and the pair electrode plate 107 constitute a discharging electrode, and each discharge electrode 111 and the pair electrode plate 107 are connected to the power converter of the power supply unit 112.

Each of the flow air guide members 105 serving as transfer fluid guiding members has such a shape that a cylinder whose diameter is sufficiently larger than that of the corona C generated around the tip end 111*a* of the discharge electrode 111 is substantially halved. This flow air guide member 105 is disposed between the discharge electrode 111 and the air blower 102, and becomes parallel with each discharge electrode 111 and is fixed to the duct 104. The flow air guide member 105 with a halved cylindrical shape is directed to the discharge electrode 111 on an inside-diameter side thereof, and a downstream-side end thereof is positioned on a more upstream side than a center axis of the discharge electrode 111 so that the tip end 111*a* of the discharge electrode 111 is hidden when viewed from a side of the air blower 102.

An operation of the ion generating apparatus 101 according to the present embodiment will be described below. In FIG. 5, when several kV or more AC voltage is supplied to the pair electrode plate 107 and the discharge electrodes 111, which constitute the discharging electrodes, from the power supply unit 112, the corona discharge occurs between these discharging electrodes, so that the air flowing in the duct 104 is ionized and blown out from the duct outlet port 104*a*.

Although the coronas C are generated around the tip ends 111*a* of the discharge electrodes 111, the flow air guide members 105 guide such flow directions that the air flowing in the duct 104 does not rush directly against the corona generating region formed around the tip end 111*a*. That is, the flow air guide members 105 with a halved cylindrical shape divide the air flow and bias and guide the divided air flows in side directions of the entire discharge electrode 111 and the corona generating region. Thus, even when the flow amount of air is increased or decreased, it is possible to almost prevent a change in pressure or flow rate in the corona generating region and to keep always the ion balance stable.

Since the downstream-side end of the flow air guide member 105 that the present embodiment has is also positioned on the more upstream side than the center axis of the discharge electrode 111, ions can be carried better by the air flowing immediately close to the corona C and the ion balance is more stabilized.

Note that the transfer fluid guiding member is not limited to the halved cylindrical shape of the flow air guide member 105 and may have another structure if the flow direction is guided by another structure so that the air flowing in the duct 104 does not rush directly against the corona generating region.

The present invention is not limited to the above embodiments, and may be variously modified within a scope of not departing from the gist thereof. For example, transfer fluid to be supplied may utilize $N_2$ gas and the like in addition to compressed air (atmospheric air).

INDUSTRIAL APPLICABILITY

The ion generating apparatus according to the present invention is used for generating the ionized air for removing static electricity from various members such as electronic parts.

The invention claimed is:

1. An ion generating apparatus comprising:

a conductor blow tube having a through hole, which is formed therein and communicates with a fluid inlet port formed in an apparatus body and in which transfer fluid flows;

a discharge electrode whose tip end is positioned in the through hole; and a transfer fluid guiding member for guiding a flow direction so that the transfer fluid does not rush directly against a corona generating region formed around the tip end;

wherein a downstream-side end of the transfer fluid guiding member with respect to a flow direction of the transfer fluid is positioned on a more upstream side in the flow direction than the corona generating region.

2. The ion generating apparatus according to claim 1, further comprising:

a cylindrical insulating member assembled in an inner circumferential face of the through hole, wherein an outer circumferential face of the insulating member is fitted in the inner circumferential face of the through hole.

3. The ion generating apparatus according to claim 2, further comprising:

a nozzle fitting screwed on a downstream-side of the insulating member so as to be detachable from the conductor blow tube.

4. The ion generating apparatus according to claim 1, wherein the transfer fluid guiding member comprises:

a cylindrical housing tube portion for receiving most of the discharge electrode on an inside-diameter side; and a tapered guide portion formed in a tapered shape at a downstream-side end of the housing tube portion.

5. An ion generating apparatus comprising:

an apparatus body incorporating an air blower therein;

a duct attached to the apparatus body and guiding transfer fluid discharged from the air blower to the outside;

a discharge electrode whose tip end is positioned and attached in the duct;

a pair electrode attached in the duct; and a transfer fluid guiding member for guiding a flow direction so that the transfer fluid does not rush directly against a corona generating region formed around the tip end;

wherein a downstream-side end of the transfer fluid guiding member with respect to a flow direction of the transfer fluid is positioned on a more upstream side in the flow direction than the corona generating region.

6. The ion generating apparatus according to claim 5, wherein the transfer fluid guiding member has a shape such that a cylinder whose diameter is sufficiently larger than that of a corona generated around a tip end of the discharge electrode is substantially halved.

* * * * *